United States Patent [19]

Durrant

[11] 4,403,362

[45] Sep. 13, 1983

[54] BULK LOADING FACILITY HAVING A DROP WAY

[76] Inventor: Richard Durrant, 315 London Rd., Sarnia, Ontario, Canada

[21] Appl. No.: 222,007

[22] Filed: Jan. 2, 1981

[51] Int. Cl.[3] ..... E01D 1/00

[52] U.S. Cl. ..... 14/71.1

[58] Field of Search ..... 14/71.1, 69.5; 182/82, 182/1

[56] References Cited

U.S. PATENT DOCUMENTS

| | | | |
|---|---|---|---|
| 2,502,181 | 3/1950 | Stacey | 14/71.1 X |
| 2,527,653 | 10/1950 | Pierce | 14/71.1 |
| 2,803,841 | 8/1957 | Wellens | 14/71.1 |
| 3,163,873 | 1/1965 | Hopkins | 14/71.1 |
| 3,216,373 | 11/1965 | Boone | 14/71.1 X |
| 3,595,510 | 7/1971 | Hutchinson | 182/82 X |
| 3,808,625 | 5/1974 | Fowler | 14/71.1 |
| 4,168,764 | 9/1979 | Walters | 182/1 |
| 4,171,550 | 10/1979 | Phaup | 14/71.1 |
| 4,280,243 | 7/1981 | Durrant | 14/71.1 |

*Primary Examiner*—Nile C. Byers, Jr.
*Attorney, Agent, or Firm*—William L. Fisher

[57] ABSTRACT

Improvement in a bulk loading facility having a fixed deck having a drop way projecting from and hinged to said deck so that it can be raised or lowered for loading, the drop way having an extendible deck slideably supported from and attached to the outboard end thereof, the drop way having a handrail assembly the improvement comprising a mechanism for operating the extendible deck including a lever type mechanism having a hand lever having a fulcrum and a locking mechanism, the fulcrum being fastened to the handrail assembly, the lower end of the lever being affixed to the deck for actuating same, the locking mechanism being operative upon release of the lever to lock the deck in position.

34 Claims, 16 Drawing Figures

BULK LOADING FACILITY HAVING A DROP WAY

My invention relates to bulk loading facilities.

The principal object of my invention is to provide improvements in drop ways, commonly known as gangways and drop platforms, used on bulk loading facilities.

The foregoing object of my invention and the advantages thereof will become apparent during the course of the following description, taken in conjunction with the accompanying drawings, in which.

Figure 1:
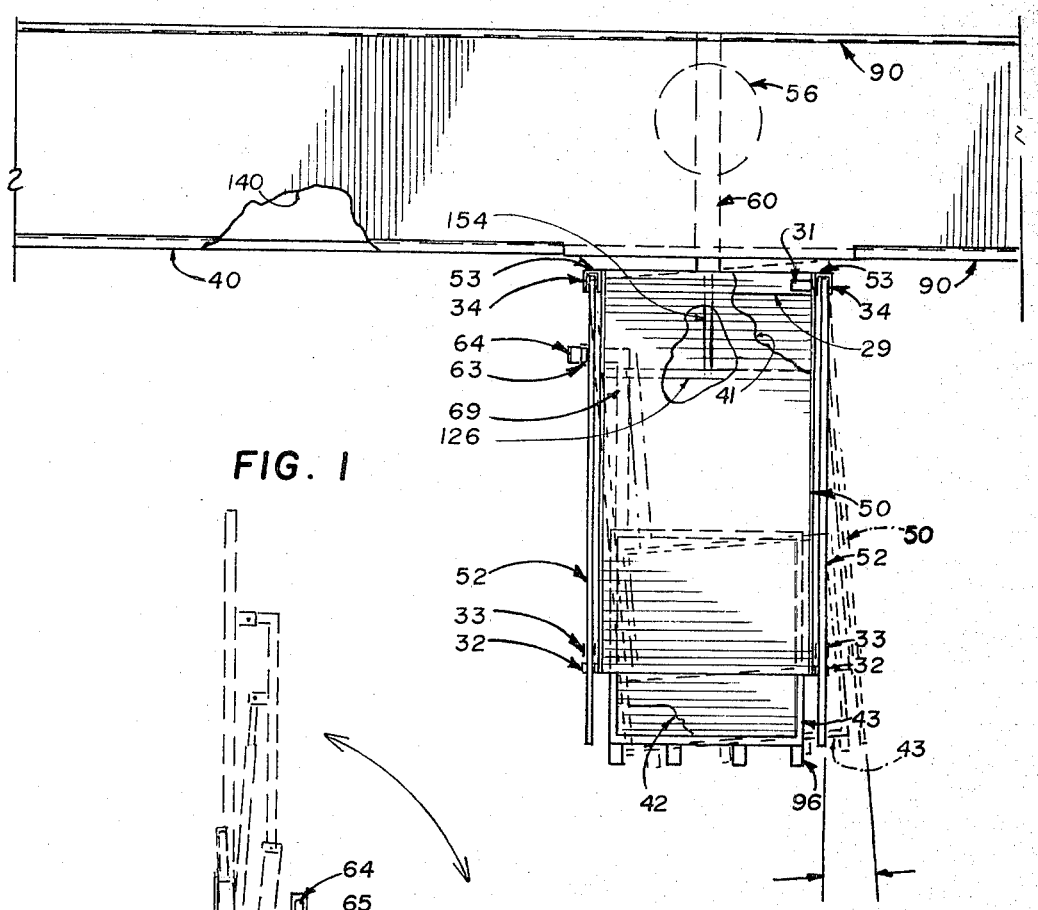
FIGS. 1 and 2 are, respectively, top plan and side elevational views of an improved drop way embodying my invention.
Figure 2:
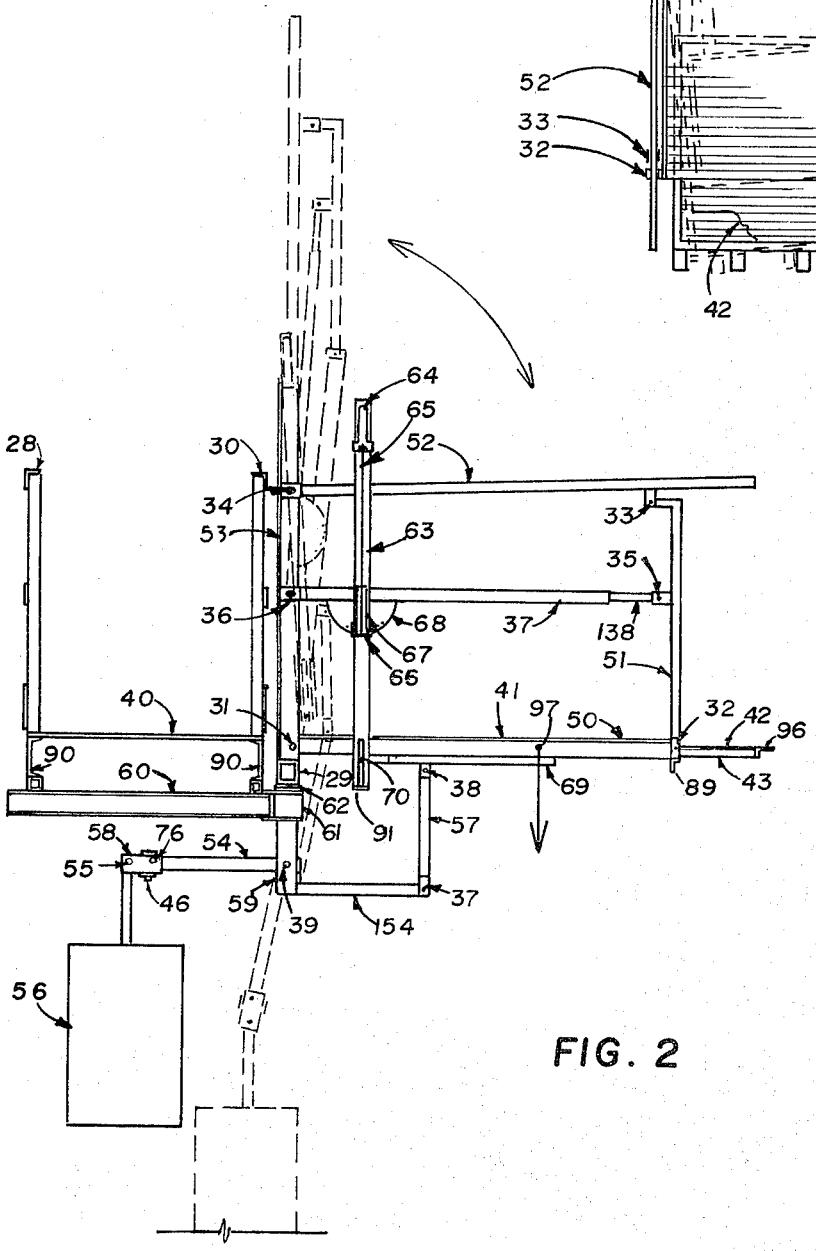
Figure 3:
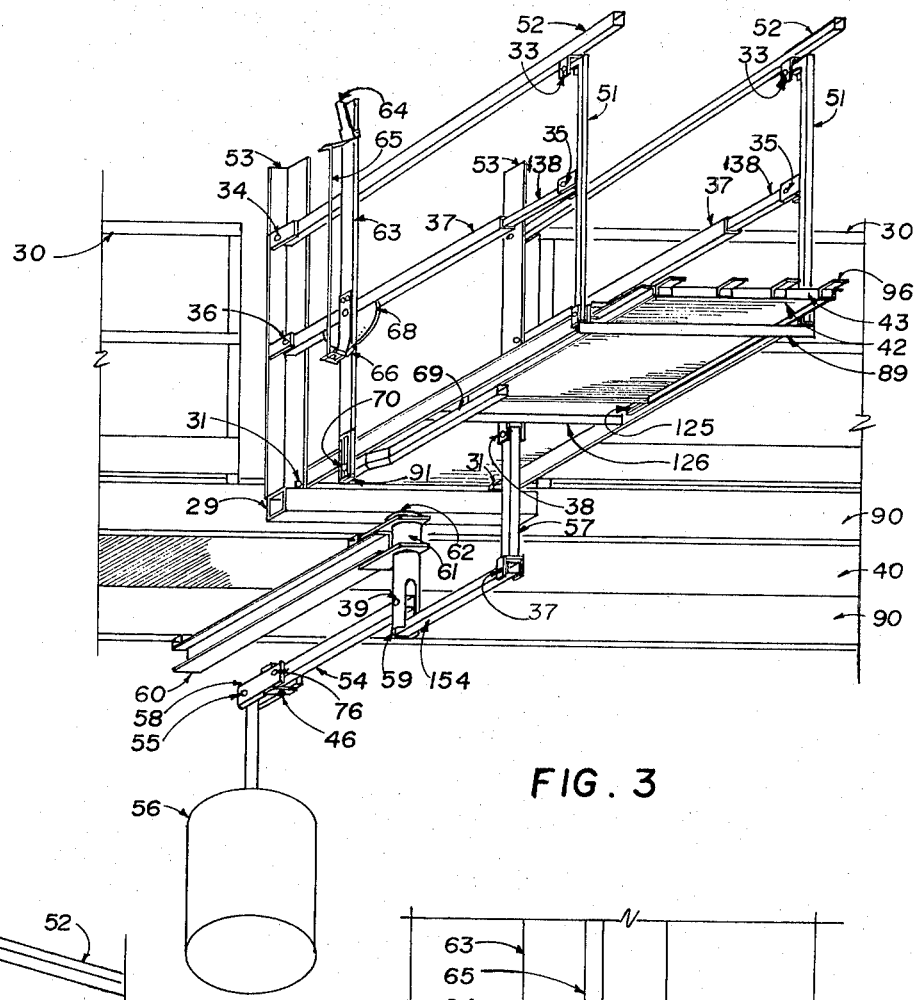
FIG. 3 is a perspective view from the underside of said drop way.
Figure 4:
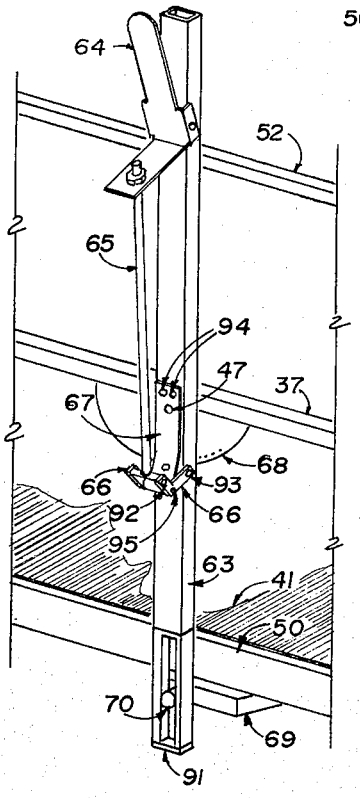
FIGS. 4–6 are, respectively, fragmentary perspective, side elevational and vertical sectional views of a part of said drop way.
Figure 5:
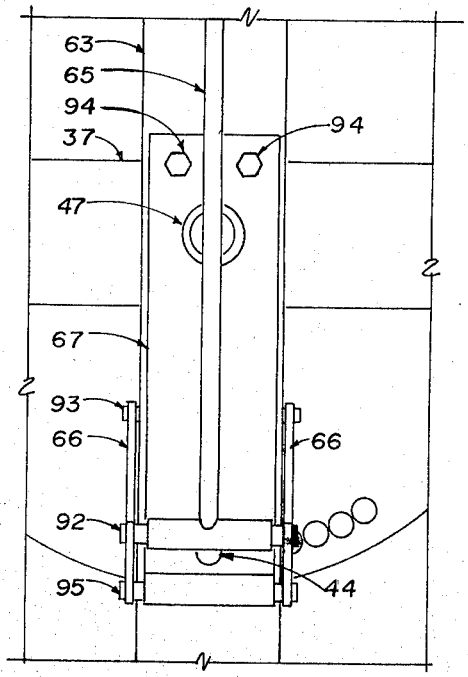

Referring to the drawings in greater detail and first to FIGS. 1 through 6, a drop way 50 is illustrated therein which is hinged to a fixed deck 40 via a vertically rotatable rigid subframe. Said fixed deck 40 consists of vertical support columns (not shown), main beams 90, cross beams 60, decking and guard rail assemblies 28 and 30. Said subframe consists of beam 29, rigid uprights 53, pivot guide 61 and tubular post 59. Pivot guide 61 is rigidly connected to the fixed deck 40 via a cross beam 60. Post 59 is rigidly connected to the subframe beam 29 with a bearing plate 62 therebetween; said beam 29, uprights 53, bearing 62 and post 59 are free to rotate about the vertical axis formed by pivot guide 61. The drop way 50 is made up of a mainframe having decking 41 thereon, a pair of hinge elements 31 and a handrail assembly consisting of a pair of vertical posts 51, a pair of handrails 52 and a pair of telescoping middle rails 37 and 138. The handrails 52 are pivotally connected to the posts 53 by hinges 34 and the middle rails 37 are also pivotally connected to the posts 53 by hinges 36. Middle rails 138 are pivotally connected to posts 51 by hinges 35 and the posts 51 are pivotally connected to the drop way mainframe and to the handrails 52 by hinges 32 and 33, respectively. A counterbalance assembly is provided for said drop way 50 comprising a counterweight 56 and a four-bar mechanism consisting of pins 31, 37, 38 and 39, members 57 and 154, the rigid subframe 53, 29 and 59 and the drop way mainframe. Member 57 is connected to crossbar 126 by pin 38 and crossbar 126 is rigidly joined at its extreme ends to the drop way main frame. Because said four bar mechanism is a parallelogram, a torque applied to member 154 at pin 39 is translated to a force on member 57 which in turn acts on member 50 at pin 38 through member 126 and produces on member 50 at pin 31 an identical torque. The force of the counterbalance weight 56 acting at pin 55 produces a torque at pin 39 which is proportional to the length of the moment arm 54 and the mass of the counterbalance weight and which torque is therefore transferred by said four bar mechanism to act at pin 31. Therefore any relationship of distance such as position with respect to the center of gravity of the drop way 97 which exists at pin 31 is effectively transposed by said four bar mechanism to pin 39. Therefore the counterbalance weight 56 has a positive eccentricity since a line drawn through the center of pin 39 having a slope similar to the slope of the line joining the center of pin 31 and the center of gravity of the drop way 97, passes below the center of pin 55. The counterweight 56 is joined to the member 54 by an adjustable retention member 58 and pins 55 and 76; the member 58 being positionable along the length of member 54. The post 59 is slotted to receive the members 54 and 154 which are rigidly joined together and offset from each other; the member 54 being pivotally connected to post 59. The decking 41 has a non-slip surface and load bearing capacity of not less than 100 pounds per square foot and is securely anchored to the mainframe by suitable fasteners (not shown). All hinges (31, 32, 33, 34, 35, 36, 37, 38, 39, 55 and 76) are conventional pin-in-sleeve type hinges acting in double shear for strength, rigidity, increased lubricant life and decreased maintenance.

A frame extension 43 with suitable decking 42 thereon is slideably mounted at the front end of the drop way 50 beneath the decking 41 and within the drop way mainframe 50 so as to permit horizontal translation thereof. The extension 43 has an angle iron frame which is supported and slides on the horizontal flat bar 125 (FIG. 3) rigidly mounted to the inside of the drop way main frame 50. A front cross member 89 of the drop way mainframe limits forward travel of said extension 43. The front end of said extension 43 is provided with spaced apart supports 96 which bear against the vessel to be loaded. The rear end of said extension 43 is connected to an actuating lever 63 by a rigid push bar 69 and pin 70. The actuating lever 63 is pivotally connected to midrail 37 by a pin 47 and is secured in place by a cotter pin 45. Differential motion between pin 70 and lever arm 63 is taken up by actuating forks 91. The actuating lever 63 is normally restrained from rotational movement by means of a deadbolt locking mechanism comprising a hand lever 64, a connecting rod 65, cam arms 66, a deadbolt pin 44 and spring 67. The spring is secured at one end to lever arm 63 by a bolt 94. The cam arms 66 are pivotally connected to the lever arm 63 by a pin 93 and to the connecting rod 65 by a pin 92. The spring 67 has affixed thereto a pin 44 and is mechanically interlocked to cam arms 66 by a pin 95. In the at rest position of the lever arm 63, the pin 44 engages one of a plurality of holes in a plate 68 which, in turn, is rigidly connected to midrail 37.

In operation, said drop way 50 acts as a hinged extension to the fixed deck 40 and when lowered to the horizontal or near horizontal plane provides access for workmen to the top or side of a vehicle, vessel or container for loading purposes; whenever the term loading is used herein it should be understood that it includes unloading or any other activity associated with loading or unloading. The drop way 50 can be raised away from the vehicle or vessel to permit movement of the latter. The drop way is normally stored in its raised position and is lowered after the vehicle to be loaded is moved into loading position. The front cross member 89 of the mainframe 50 normally does not reach the vehicle so that the extension 43 is usually extended such that the supports 96 rest on the vehicle or vessel. The workman actuates the extension 43 by squeezing hand lever 64 and lever arm 63 together with one hand which pulls the connecting rod 65 upwardly and raises cam arms 66. This action lifts the spring 67 and retracts the pin 44 from the plate 68 thus releasing the rotational restraint on lever arm 63. While squeezing the hand lever 64, the workman either pulls or pushes the upper end of the lever arm 63 which pivots about the pin 47 and moves the extension 43 via actuating forks 91, pin 70 and rigid link 69. The extension 43 is thus extended or retracted relative to the drop way mainframe. On releasing the hand lever 64, the deadbolt mechanism is brought into operation by the spring 67 which tends to press the pin 44 into one of the apertures in the plate 68. On continued movement of the lever arm 63, the pin 44 will engage one of the holes in plate 68 and will restrain lever arm 63 from further motion. The spatial arrangement of the holes in plate 68 is such as to limit the incremental placements of the extension 43 to a distance less than the length of the supports 96. Thus, the extension 43 can always be positioned to bear on the vehicle or vessel being loaded while at the same time it is restrained against movement by the deadbolt locking mechanism. By the arrangement shown, the lever arm 63 can be actuated by an operator without stepping unto the drop way and while the drop way is unsupported at its outboard end. This feature is essential in use of the extendible deck 43 to enable the operator to extend same so as to bear on the vehicle being loaded to assist in support of the weight of the drop way and superimposed loads. Further, the lever arm 63 as designed will not interfere with the raising of the drop way or its collapse to minimum profile in its raised position.

Since accurate positioning of vehicles is not always possible, it may happen that the desired access point is displaced laterally from the drop way 50. Provision is made to rotate the entire drop way 50 about a vertical axis to accommodate small errors in vehicle positioning. The workman accomplishes this by grasping the uprights 53 and applying a rotational force thereto (push on one and pull on the other). The rigid subframe including uprights 53, crossbeam 29, bearing 62 and post 59 rotate about the vertical axis within main pivot 61. The amount of rotation is limited only by the horizontal clearance between the rigid subframe assembly 53, 29, 59, and the fixed platform beams 90 which is predetermined by the positioning of support beam 60. Once the drop way 50 is rotated, the extension 43 is positioned, as described above, to bear on the vehicle.

The counterbalance mechanism comprising the counterbalance weight 56 and said four-bar mechanism acts through the horizontal axis 31 of rotation of the drop way 50 and independently of the rotation of the drop way 50 about the vertical axis 61. Member 154 is offset from member 54 at pivot 39 to permit full collapse of the drop way 50 when in the raised position. An adjustment mechanism is provided for the counterbalance weight 56 consisting of retention member 58, pivot pins 55 and 76 and an adjusting bolt 46 to adjust the eccentricity of the action of the counterbalance weight in respect to the effective line of action through the center of gravity 97 (FIG. 1) of the drop way 50 and through the hinge element 31, Said line of action is offset by said four-bar linkage mechanism acting about pivot pins 39, 37, 38 and 31; such eccentricity is effective in imparting to the drop way 50 the self restraining force desired in the raised position. The self restraining force in the lowered position is adjusted by increasing or decreasing the mass of the counterbalance weight 56.

Figure 6:
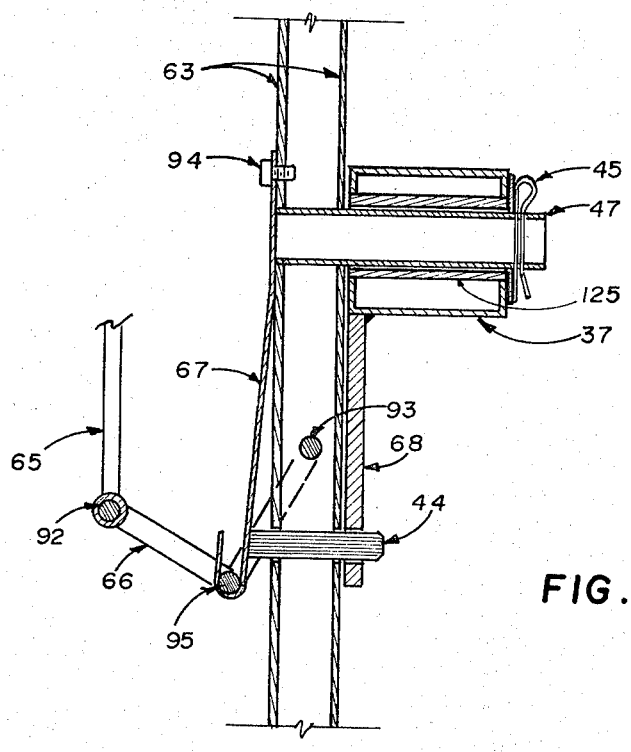
Figure 7:
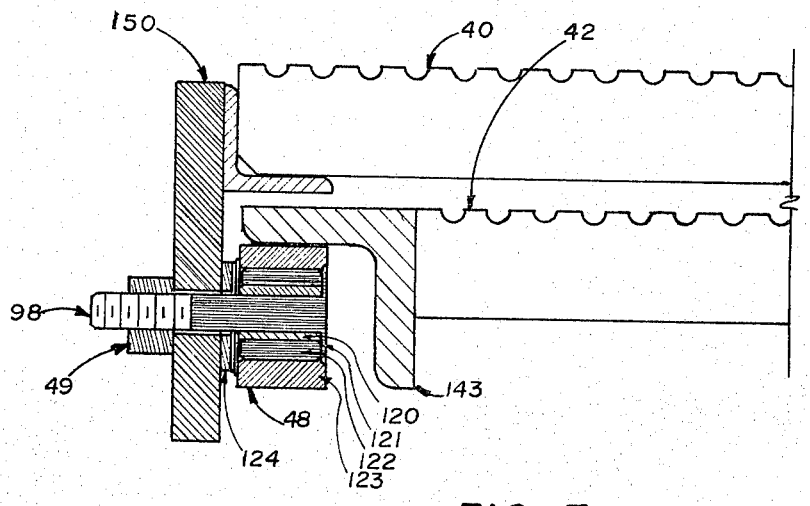
FIGS. 7 and 8 are, respectively, fragmentary vertical sectional and side elevational views of a modified form of said drop way.
Figure 8:
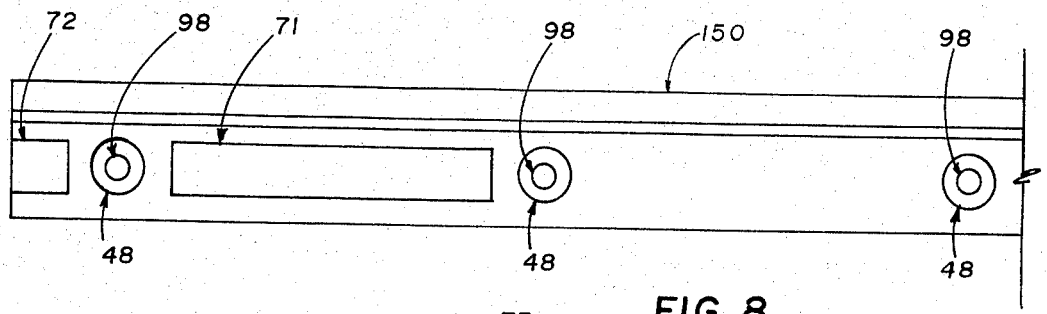

Referring now to FIGS. 7 and 8 a typical application is illustrated in which the extension 43 is supported on roller bearings 48 spaced along and fixed to the inside of the mainframe of the drop way designated 150. Each roller bearing is attached to said mainframe by a threaded axle 98 and a nut 49. Each roller has an inner race 120, a dirt seal 121, a roller bearing 122, an outer race 123 and a spacer washer 124. Fail-safe support blocks 71 and 72 (FIG. 8) are made fast to the inside of the drop way mainframe at the front end thereof between the first and second roller bearings 48. The extension 143 normally clears these support blocks 71 and 72 by a small amount but in the event that the roller bearings 48, shaft 98 or retaining nut 49 break or come loose the support blocks 71 and 72 will provide emergency support to the extension 43. Full roller support for the extension 43 as shown in FIGS. 6 and 7 considerably decreases the frictional resistance with sliding assemblies and permits use of higher leverage ratios in the actuating lever 63. Consequently, longer extensions 143 can be employed with the same or less operating effort on the part of the workman. The roller bearing support, mounted as shown on the inboard side of the drop way mainframe 50 are not susceptible to ice build-up and subsequent jambing as is often experienced in less temperate climates, and avoids the problem of increasing friction forces due to corrosion, scale build-up and build-up of dirt and foreign material on the slideways.

Figure 9:
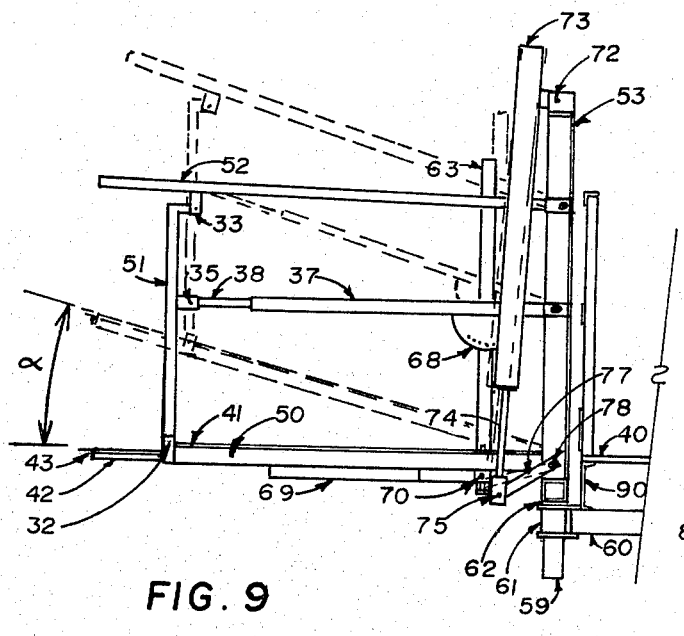
FIGS. 9 and 10 are, respectively, side elevational and perspective views of another modified form of a drop way embodying my invention.
Figure 10:
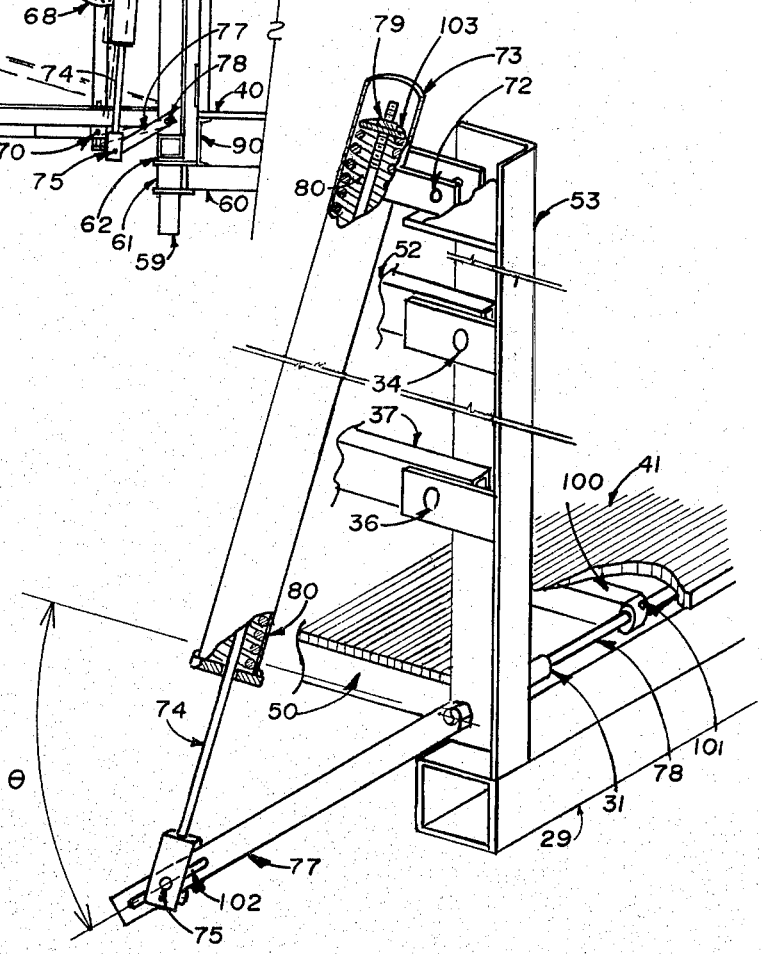
Figure 11:
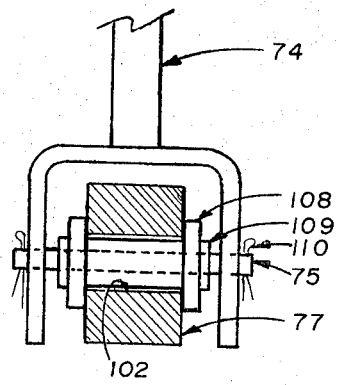
FIG. 11 is a fragmentary elevational view with parts in section of a part of the structure of FIGS. 9 and 10.

Referring now to FIGS. 9–11 a modification is illustrated in which a spring force is used to counterbalance the drop way 50. This modification includes a torsion bar 78, a torsion arm 77, a tension rod 74, a connecting pin 75, a spring housing 73, a spring 80, an adjusting nut 79, and a connecting pin 72. Torsion bar 78 is connected to the central longitudinal axis of the mainframe of drop way 50 by a lever arm 100 and shear pin 101. The spring force is transmitted to the torsion bar 78 by tension rod 74 acting on torsion arm 77 through connecting pin 75. A slotted hole 102 is provided in torsion arm 77 to enable adjustment of the length of the moment arm through which the spring force acts, thereby adjusting the counterbalancing force. The spring 80 is compressed by the tension rod 74 acting through cap plate 103 and adjusting nut 79.

The length of the moment arm is made variable by the mechanism shown in section in FIG. 11 whereby pin 75 is retained in sleeve 109 which is secured within a slotted hole 102 in lever arm 74 by retention nuts 108 and where pin 75 is retained by cotter pins 110 and whereby the location of pin 75 along the moment arm 77 establishes the effective length of the moment arm and the moment of the applied spring force. When tightened, nuts 108 hold sleeve 109 in slot 102 by frictional retention. The hold-up force imparted to the drop way while in the raised position by the spring action is a function of the precompression of the spring 80. The precompression of the spring 80 is adjusted by the adjusting nut 79. The gravity moment of the drop way 50 about the main hinge axis 31 is a function of the fixed weight of the drop way 50 acting at a fixed distance from the main hinge point through an angle $\alpha$ (FIG. 9). In this modification the torque of the torsion bar 78 is arranged to counterbalance such gravity moment of the drop way 50 by application of a restoring torque through lever arm 100. The restoring moment provided by the spring 80 is a function of the spring force, which is in turn a function of spring travel. Spring travel is linear and a function of the moment arm 77 and the angle $\alpha$ (FIG. 9). Since the spring force increases with spring travel and since this is a function of the compound angle $(\alpha-\theta)$, the resulting moment is a compound function of the angle of inclination of the drop way. It is important to match the restoring moment of the spring to the gravity moment of the drop way to achieve smooth, effortless operation of the drop way and to achieve a gentle transition of unbalanced moments from "hold-up" mode in the raised position to the "hold-down" mode in the lowered position. It is therefore necessary to make the angle $\theta$ significant relative to the overall system. Values of $\theta$ which are suitable for manual operation of the drop way lie within the range $-20°$ to $-40°$. The value of $\theta$ depends to some degree on the magnitude of any superimposed loads added to the drop way whose gravity moments do not follow the cosine relationship of the drop way. Such loads added outboard to the drop way require that the value of $\theta$ be increased. Such loads can be encountered in the form of attachments to retain tools, operating equipment, etc., or as appendages to the drop way such as a safety cage or platform addition. In order to limit travel of the drop way below a predetermined angle the spring may be preselected to come to full compression at the desired travel. Alternately the connecting rod can be fitted with suitable collars to limit the angular travel of the drop way to its useful working range and to prevent excessive travel of the spring.

Figure 12:
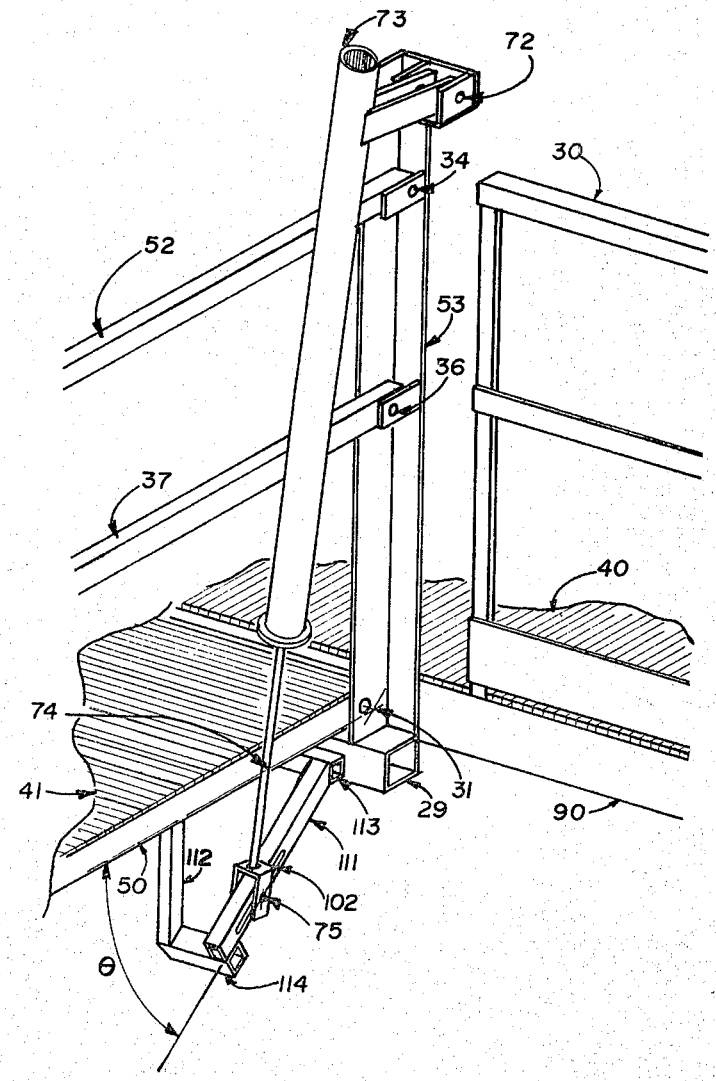
FIG. 12 is a perspective view of another modified form of one side of a drop way embodying my invention.

Referring now to FIG. 12 a further modification to the spring attachment as discussed above is shown therein which eliminates the need for a torsion bar . In this modification the use of two spring assemblies is assumed (one side only shown) disposed on to each side of the drop way in much the same manner as shown in FIGS. 9, 10, and 11 except that the tension rod 74 is now pivotally connected by pin 75 to member 111 having a slotted hole 102, fitted with a sleeve 109 having retention nuts 108 and where pin 75 is secured to the drop way main frame by members 112 and 113, respectively. Member 111 resides at an angle below the axis of the drop way mainframe as noted before and has its axis aligned radially to the drop way main hinge 31. The effective length of the moment arm is established by the linear displacement of pin 75 from the drop way main hinge 31.

By selection of angle $\theta$ and adjustment to the moment arm and preset spring travel the spring assemblies illustrated both in FIGS. 9-11 and 12 are capable of closely duplicating the gravity moment of the drop way through its entire effective angular motion from $-15°$ to $+90°$. The drop way is bias-balanced by spring 80 when the gravity moment is not exactly duplicated and exhibits desirable and controlled out-of-balance characteristics. My arrangement makes the amount of out-of-balance small throughout the travel of the drop way to minimize operating effort. However, the out-of-balance is sufficient to hold the drop way up when it is in is raised position and down when it is in its lowered position. Control of "hold-down" and "hold-up" forces and counterbalancing the gravity movement components of attachments to the drop way (which are articulated relative to the four-bar linkage of the handrails) are possible with the spring counterbalance system described herein. The hold down force is inversely proportional to the length of the moment arm and the force imparted by the pretensioning of the spring. The hold-up force is proportional to the pretensioning of the spring and, to a lesser extent, inversely proportional to the length of the moment arm. Increasing the pretensioning increases the hold-up force and decreases the hold-down force by a similar amount. Increasing the moment arm decreases the hold-down force and has the effect of marginally decreasing the hold-up force by decreasing the pretensioning displacement when the platform is in the raised position.

Figure 13:
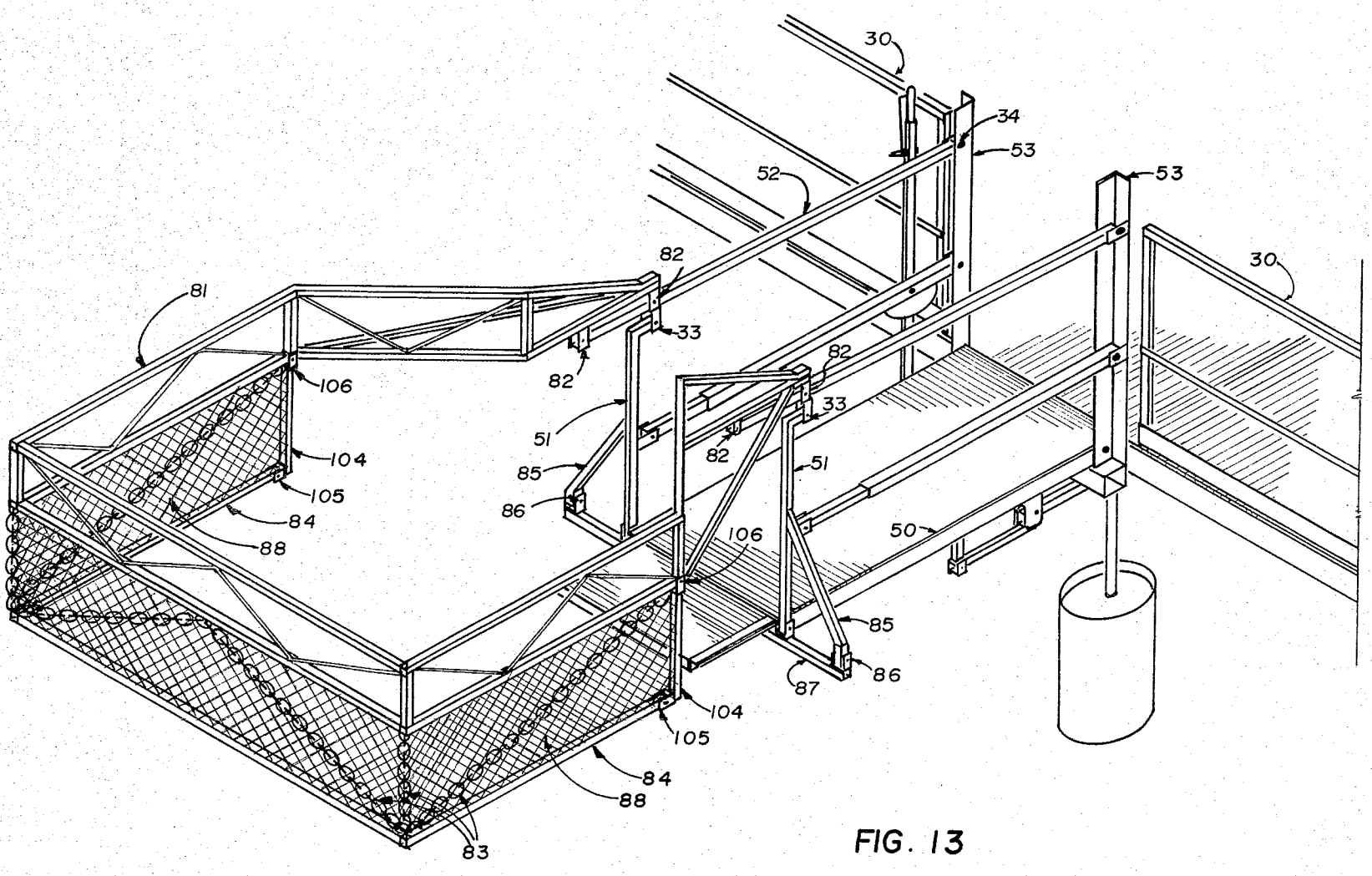
FIGS. 13 and 14 are, respectively, perspective and side elevational views of the drop way of FIGS. 1–8 equipped with a safety cage embodying my invention.
Figure 14:
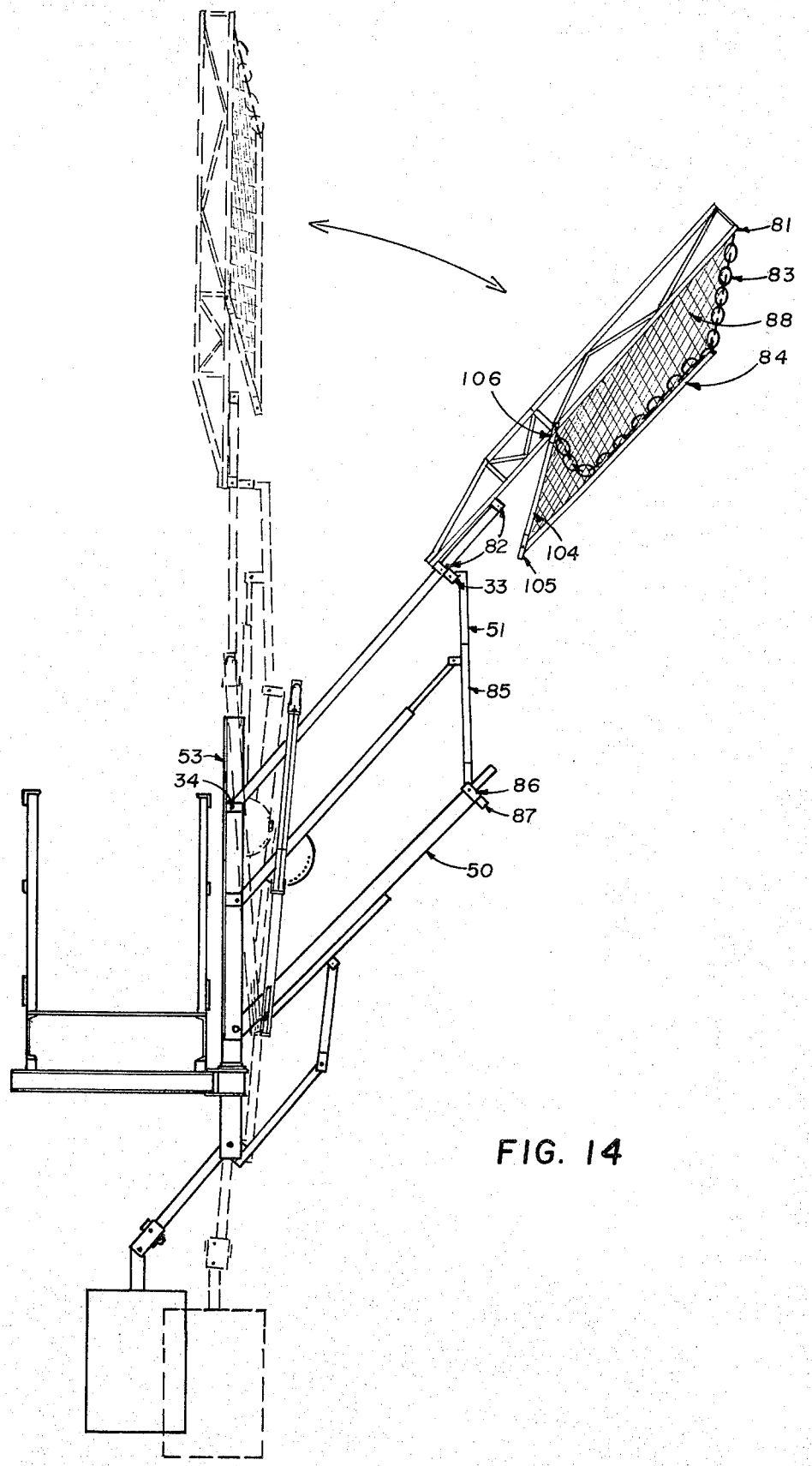

Referring now to FIGS. 13 and 14, a further modification is shown in which a safety net is attached to the drop way. The safety cage comprises a rigid structural double rail top frame 81 fixed to the top rail 52 of the drop way by members 82. A bottom frame 84 is suspended from and braced to frame 81 by chains 83 and members 104 which are pivotally connected to frame 84 and 81 by pins 105 and 106, respectively. The opening between the frames 81 and 84 is enclosed by a cage or canvas 88. The drop way is strengthened by addition of members 87 and 85 and pivotally connected to each other by pin 86 and rigidly connected to the drop way mainframe 50 and vertical post 51. The safety cage, being rigidly connected via top frame 81 to the top rail 52, pivots in the vertical plane about hinge point 34 on the main subframe 53. The structural frame is generally hoop shaped, open to the drop way and without decking. In use, the safety cage assembly surrounds the work space, on top of a vehicle, on three sides and provides in conjunction with the drop way handrails, a continuous railing from the fixed platform 40 to the vehicle being loaded, capable of protecting the workman from falling. The frame 84 is free to articulate in a manner to accommodate obstructions on top of the vehicle such as handrailings, pipes or other devices without interfering with the positioning of the drop way or extension frame and without loss of protection to the workman. Member 104 provides lateral stiffness as a result of the rigidity of the pinned joints 105 and 106. In the raised position the safety net collapses under its own weight, whereby frame 84 collapses to frame 81, thus presenting the narrowest of possible profiles. The narrow profile most easily accommodates railway specified clearance in effect in all railcar loading operations. Since the safety cage angulates with the drop way, no extra considerations are required to ensure the proper operation of the counterbalancing mechanisms. The netting or canvas 88 is attached to the frames 81 and 84 by removeable fastenings and serves to complete the enclosure of the workspace regardless of the displacement of the lower frame 84.

Figure 15:
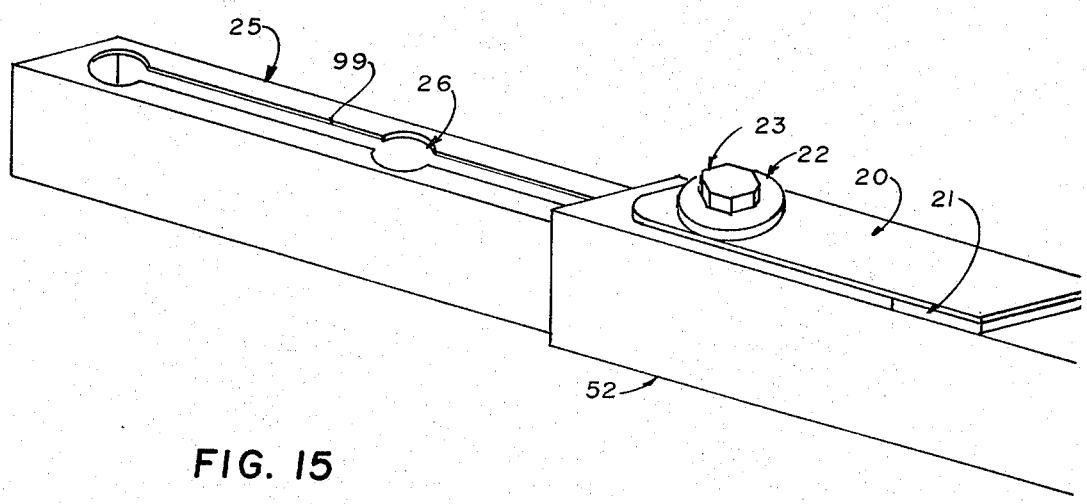
FIGS. 15 and 16 are, respectively, perspective and vertical sectional views of a modified form of handrail for said drop way.
Figure 16:
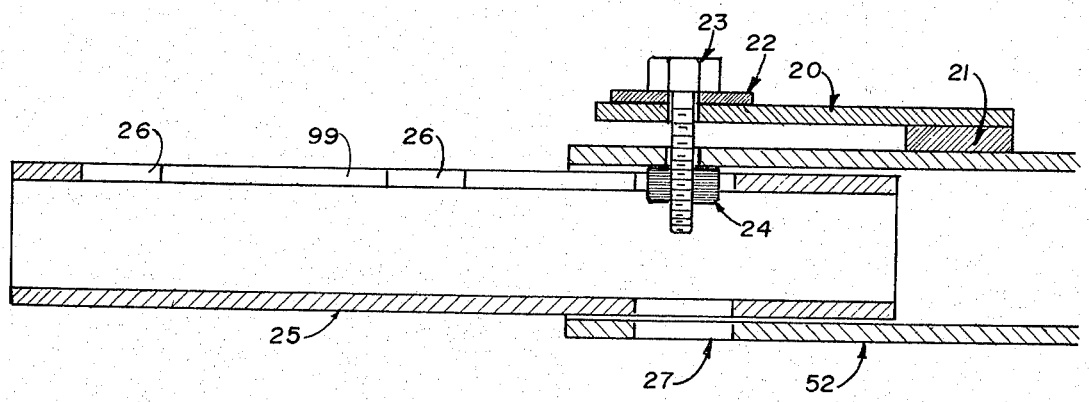

Referring now to FIGS. 15 and 16 another modification is illustrated in which a member 25 is arranged to fit within the top rail 52 in a telescoping manner. The member 25 effectively extends the useful reach of the top rail. Slots 99 with enlarged holes 26 at predetermined positions are provided in member 25. The slot 99 is engaged within the top rail 52, by bolt 23 but the nut 24 is of sufficient size that it can only engage the holes 26 at their various locations. Bolt 23 is retained by washer 22 and is restrained in the raised position by spring 20. Spring 20 is spaced from and attached to handrail 52 by block 21. In operation, the nut 24 is normally held against the upper surface of top rail 52 and engages one of the holes 26, thus restraining member 25 from lateral displacement. To reposition member 25, bolt 23 and hence nut 24 is depressed against the spring force. Once depressed, the nut 24 is disengaged from the hole 26 and member 25 can be displaced laterally except that the engagement between the slot 99 and the shaft of the bolt 23 limits the total possible displacement of member 25. After member 25 is repositioned, bolt 23 is released and nut 24 re-engages one of the holes 26. The extension 25 to the top rail 52 permits enclosing of the variable gap that often remains between the drop way and the vehicle being loaded after the drop way is positioned. The deadbolt engaging mechanism provided in this modification ensures that the extension will not retract due to human error in positioning or securing of any auxiliary fasteners.

It will thus be seen that there has been provided by my invention improvements in drop ways for bulk loading facilities in which the object hereinabove set forth, together with many practical advantages, has been successfully achieved. For example, the operating mechanism for the extension is fitted with a deadbolt locking device which secures the extension at any number of discrete intervals. By grasping and squeezing the lever 63 and hand lever 64 the operator releases the deadbolt restraint and by pulling or pushing on the lever the operator positions the extension 43 to the desired degree of extension. The hand lever 64 is released and lever 63 moved slightly until the deadbolt is re-engaged in the plate 68, thus securing the extension 43 in the desired position. This mechanism provides a safe positive restraint for the extension 43 against retraction while in use. Since the drop way is often used in an inclined position to gain access to vehicles which are taller than the top of the fixed platform there is a gravity tendency for the extension to retract and in doing so would release the frontal support for the drop way. Such a retraction is most likely to occur while the operator is walking on the extendible frame but can also occur while the operator is on the vehicle. Failure of the restraint mechanism in the first instance may cause the operator to fall, while failure in the second instance will leave the operator stranded on the vehicle and will remove all advantages of having a dropway. The self actuated deadbolt mechanism described herein will prevent failure of the restraint mechanism.

The spring counterbalance which acts at an adjusted angle from the mainframe of the dropway and acts on the dropway indirectly by way of a torsion bar arrangement, has been incorporated in the dropway. Since the spring acts through an angle which is offset to the dropway in all instances, the counterbalancing force imparted by the spring is always similar to the gravity moment of the dropway except that the spring force can be set by adjustments to be underbalancing when the dropway is in the lowered position to produce a net "hold down" force and over balanced when the dropway is in the raised position to produce a net "hold up" force. The torsion bar attachment causes the counterbalancing force to act along the longitudinal axis of the dropway in a balanced manner for a smooth undistorted motion of the dropway.

The safety cage, which acts as a guard rail around the work area, is attached directly to and is an integral working part of the dropway. This safety cage completely surrounds the work area providing both top and mid rails and intermediate netting or canvas and is required to prevent falls and related injury to the workman. Since the work area is completely surrounded, the use of a safety harness is not required. Since the safety cage acts as an integral part of the dropway, and in addition since the midrail of the safety cage is free to adjust to any railing or other obstructions which are encountered on the vehicle, the safety cage is always in proper and most effective position whenever the dropway is used. There is no chance of human error to negate the usefullness of the safety cage.

The extension to the top rail, which increases the effective length of the top rail, is telescopically and slideably joined to the top rail. The extension of the top rail when used in conjunction with vehicles having railings, extends the dropway top rail to overlap the handrail on the vehicle and block any intervening opening which would otherwise exist. This effectively provides a continuous barrier around the work space for such vehicles. The extension to the handrail is retracted when not in use.

While preferred embodiments of my invention have been shown and described, it is to be understood that variations and changes may be resorted to without departing from the spirit of my invention as defined by the appended claims.

What I claim is:

1. Improvement in a bulk loading facility having a fixed deck having a drop way projecting from and hinged to said deck so that it can be raised or lowered for loading, said drop way having an extendible deck slideably supoorted from and attached to the outboard end thereof, said drop way having a handrail assembly, said improvement comprising means for operating the extendible deck including a lever type mechanism having a hand lever and a locking mechanism, said lever having a fulcrum affixed to said handrail assembly, the lower end of said lever being affixed to said deck for actuating same, said locking mechanism being operative upon release of said lever to lock said deck in position.

2. Improvement as claimed in claim 1, said extendible deck having lengthwise projecting support members on the outboard end thereof, said locking mechanism controlling the movement of said extendible deck in discrete increments less than the length of said support members.

3. Improvement as claimed in claim 1, means projecting from said fixed deck providing a vertical pivot axis for said drop way and handrail assembly, whereby said drop way and handrail assembly can be rotated about a vertical axis in respect to said fixed deck.

4. Improvement as claimed in claim 1, said locking means comprising a retention plate having a plurality of apertures therein, said retention plate fastened to said handrail assembly, a locking bolt operative in the apertures of said retention plate, spring means operative upon said bolt and said hand lever operative upon said spring means for controlling the movement of said locking bolt while controlling the movement of said extendible deck.

5. Improvement as claimed in claim 4, further comprising a cam operative upon said spring means, and a connecting rod operative upon said cam, said connecting rod joined to said hand lever for actuating said locking bolt via said cam and spring means.

6. Improvement as claimed in claim 1, said drop way having roller means for slidably supporting the extendible deck and fail-safe means disposed adjacent said roller means, the top edge of said fail-safe means being disposed beneath the roller line of contact of said roller means so as to prevent said extendible deck from falling in the event of malfunction of said roller means.

7. Improvement in a bulk loading facility having a fixed deck having a drop way projecting from and hinged to said fixed deck so that it can be raised or lowered for loading, said drop way having an extendible deck slidably supported from and attached to the outboard end thereof, said improvement comprising a counter-balance system for said drop way having a gravity counterweight, and a four bar mechanism which augments the moment arm of said gravity counterweight, said four-bar mechanism including a pivotally mounted vertically offset moment arm, said moment arm being interconnected between said drop way and said counterbalance, whereby said drop way and counter-balance system have a narrow profile in the elevated position of said drop way.

8. Improvement in a bulk loading facility having a fixed deck having a drop way projecting from and hinged to said fixed deck so that it can be raised or lowered for loading, said drop way having a handrail assembly, said improvement comprising a counter-balance system for said drop way having a spring assembly, a torsion bar and a first lever arm interconnecting said torsion barn and spring assembly and a second lever arm interconnecting said torsion bar and said drop way, said lever arms being angularly displaced from each other and spaced along the length of said torsion bar, whereby said drop way is biased-balanced throughout its angular travel.

9. Improvement as claimed in claim 8, further comprising means for varying the effective length of said first lever arm including a pivot connection between same and said spring assembly, said pivot connection being moveably adjustable lengthwise of said first lever arm.

10. Improvement as claimed in claim 9, and locking means for said pivot connection to secure same against lengthwise displacement along said first lever arm.

11. Improvement as claimed in claim 8, said spring assembly comprising a compression spring, a housing and a tension rod therefor, means for fastening said housing to said handrail assembly, and means for pivotally connecting said tension rod to said first lever arm.

12. Improvement in claim 11, means for precompressing said spring assembly comprising fastening means on the free end of said tension rod for applying a pre-compression force to said spring.

13. Improvement as in a bulk loading facility having a fixed deck having a drop way projecting from and hinged to aid fixed deck so that it can be raised or lowered for loading, said drop way having a handrail assembly, said improvement comprising a counter-balance system for said drop way having a pair of spring assemblies, each spring assembly comprising a compression spring, a housing and a tension rod therefor, means for fastening the pair of spring housings to said handrail assembly, a pair of levers fastened to and disposed at angles to said drop way, and means for pivotally connecting the lower ends of said tension rods to said lever arms, respectively.

14. Improvement in a bulk loading facility having a fixed deck having a drop way projecting from and hinged to said deck so that it can be raised or lowered for loading, said drop way having a handrail assembly, said improvement comprising a safety cage assembly affixed to the front end of said drop way, said safety cage assembly forming an enclosed workspace in front of the front edge of said drop way, said safety cage assembly having a top member of structural truss design affixed to the top rail of said handrail assembly and at least one lower member flexibly supported by said truss member, whereby said safety cage assembly collapses to minimum profile in the raised position of said drop way.

15. Improvement in a bulk loading facility having a fixed deck having a drop way hinged to said deck so that it can be raised or lowered for loading, said drop way having a handrail assembly comprised of a handrail and a post for said handrail, said handrail and said post hinged to each other, said post hinged to said drop way, said handrail hinged to a second post, said second post held upright by the fixed deck, said improvement comprising a handrail extension member slideably and telescopically connected to the end of the handrail which, when extended from the handrail, increases the effective length of the handrail.

16. Improvement as claimed in claim 15, said handrail extension member being joined to the handrail by a deadbolt locking device, said device having a guide pin and a spring operative upon said guide pin so that relative motion between said handrail extension member and the handrail is prevented until the guide pin is deliberately depressed against the force of said spring.

17. Improvement as claimed in claim 16, further comprising a slotted hole in said handrail extnsion having enlargements therein and a hole in the handrail, an enlargement on the guide pin to engage matching enlargements in the slotted hole in said handrail extension, said guide pin affixed to said spring, said spring affixed to the handrail whereby the enlargement of the guide pin is encouraged to engage one of the plurality of enlargements in the slotted hole in said handrail extension.

18. Improvement in method of constructing a bulk loading facility having a fixed deck having a drop way projecting from and hinged to said deck so that it can be raised or lowered for loading, said drop way having an extendible deck slideably supported from and attached to the outboard end thereof, said improvement comprising providing a lever type mechanism having a hand lever and a locking mechanism for operating the extendible deck, said lever having a fulcrum affixed to said handrail assembly, the lower end of said lever being affixed to said deck for actuating same, said locking mechanism being operative upon release of said lever to lock said deck in position.

19. Improvement as claimed in claim 18, providing said extendible deck with lengthwise projecting support members on the outboard end thereof, said locking mechanism controlling the movement of said extendible deck in discrete increments less than the length of said support members.

20. Improvement as claimed in claim 18, providing a vertical pivot axis for said drop way and handrail assembly, whereby said drop way and handrail assembly can be rotated about a vertical pivot axis in respect to said fixed deck.

21. Improvement as claimed in claim 18, providing said locking mechanism with a retention plate having a plurality of apertures therein, fastening said retention plate to said handrail assembly, providing a locking bolt operative in the apertures of said retention plate, providing spring means operative upon said bolt, and said hand lever operative upon said spring means for controlling the movement of said locking bolt while controlling the movement of said extendible deck.

22. Improvement as claimed in claim 21, providing a cam operative upon said spring means, and a connecting rod operative upon said cam, and joining said connecting rod to said hand lever for actuating said locking bolt via said cam and spring means.

23. Improvement as claimed in claim 18, providing said drop way with roller means to slideably support the extendible deck, and providing fail-safe means disposed adjacent said roller means, the top edge of said fail-safe means being disposed beneath the roller line of contact of said roller means so as to prevent said extendible deck from falling in the event of malfunction of said roller means.

24. Improvement in a bulk loading facility having a fixed deck having a drop way projecting from and hinged to said fixed deck so that it can be raised or lowered for loading, said drop way having a handrail assembly, said improvement comprising providing a counter-balance system for said drop way having a gravity counterweight, and a four bar mechanism which augments the moment arm of said gravity counterweight, said four-bar mechanism including a pivotally mounted vertically offset moment arm, said moment arm being interconnected between said drop way and said counterbalance, whereby said drop way and counter-balance system have a narrow profile in the elevated position of said drop way.

25. Improvement as claimed in claim 24, further comprising providing means for precompressing said spring assembly comprising fastening means on the free end of said tension rod for applying a pre-compression force to said spring.

26. Improvement in a bulk loading facility having a fixed deck having a drop way projecting from and hinged to said fixed deck so that it can be raised or lowered for loading, said drop way having a handrail assembly, said improvement comprising providing a counter-balance system for said drop way having a spring assembly, a torsion bar and a first lever arm interconnecting said torsion bar and spring assembly, and a second lever arm interconnecting said torsion bar and said drop way, said lever arms being angularly displaced from each other and spaced along the length of said torsion bar, whereby said drop way is biased-balanced throughout its angular travel.

27. Improvement as claimed in claim 26, further comprising providing means for varying the effective length of said first lever arm including a pivot connection between same and said spring assembly, said pivot connection being moveably adjustable lengthwise of said first lever arm.

28. Improvement as claimed in claim 27, further comprising providing locking means for said pivot connection to secure same against lengthwise displacement along said first lever arm.

29. Improvement as claimed in claim 26, said spring assembly comprising a compression spring, a housing and a tension rod therefor, providing means for fastening said housing to said handrail assembly, and providing means for pivotally connecting said tension rod to said first lever arm.

30. Improvement in a bulk loading facility having a fixed deck having a drop way projecting from and hinged to said fixed deck so that it can be raised or lowered for loading, said drop way having a handrail assembly, said improvement comprising providing a counter-balance system for said drop way having a pair of spring assemblies, each spring assembly comprising a compression spring, a housing and a tension rod therefor, fastening the pair of spring housings to said handrail assembly, a pair of levers fastened to and disposed at angles to said drop way, and pivotally connecting the lower ends of said tension rods to said lever arms, respectively.

31. Improvement in method of constructing a bulk loading facility having a fixed deck having a drop way projecting from and hinged to said deck so that it can be raised or lowered for loading, said drop way having a handrail assembly, said improvement comprising affixing a safety cage assembly to the front end of said drop way, said safety cage assembly forming an enclosed workspace in front of the front edge of said drop way, said safety cage assembly having a top member of structural truss design affixed to the top rail of said handrail assembly and at least one lower member flexibly supported by said top truss member, whereby said safety cage assembly collapses to minimum profile in the raised position of said drop way.

32. Improvement in method of constructing a bulk leading facility having a fixed deck having a drop way hinged to said deck so that it can be raised or lowered for loading, said drop way having a handrail assembly comprised of a handrail and a post for said handrail, said handrail and said post hinged to each other, said post hinged to said drop way, said handrail hinged to a second post, said second post held upright by the fixed deck, said improvement comprising slidably and telescopically connecting a handrail extension to the end of the handrail which, when extended from the handrail, increases the effective length thereof.

33. Improvement as claimed in claim 32, further comprising joining said handrail extension member to the handrail by a deadbolt locking device, providing said device with a guide pin so that relative motion between said handrail extension member and the handrail is prevented until the guide pin in deliberately depressed against the force of said spring.

34. Improvement as claimed in claim 33, further comprising providing a slotted hole in said handrail extension having enlargements therein and a hole in the handrail, an enlargement on the guide pin to engage matching enlargements in the slotted hole in said handrail extension, affixing said guide pin to said spring, affixing said spring to the handrail whereby the enlargement of the guide pin is encouraged to engage one of the plurality of enlargements in the slotted hole in said handrail extension.

* * * * *